US007242890B2

(12) United States Patent
Yokota

(10) Patent No.: US 7,242,890 B2
(45) Date of Patent: Jul. 10, 2007

(54) IMAGE-FORMING DEVICE AND PROCESS CARTRIDGE

(75) Inventor: Eiji Yokota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 141 days.

(21) Appl. No.: 11/132,311

(22) Filed: May 19, 2005

(65) Prior Publication Data

US 2005/0260010 A1 Nov. 24, 2005

(30) Foreign Application Priority Data

May 24, 2004 (JP) ..... 2004-153116

(51) Int. Cl.
*G03G 15/00* (2006.01)
*G03G 21/18* (2006.01)

(52) U.S. Cl. ..... 399/111; 399/113; 399/117; 399/167

(58) Field of Classification Search ..... 399/75, 399/111, 88, 113, 116, 117, 167
See application file for complete search history.

(56) References Cited

U.S. PATENT DOCUMENTS

| | | | | |
|---|---|---|---|---|
| 4,922,297 | A | 5/1990 | Kondo | 399/117 |
| 6,438,341 | B1 * | 8/2002 | Matsuoka | 399/117 |
| 6,473,580 | B1 * | 10/2002 | Inomata | 399/167 |
| 6,501,926 | B1 * | 12/2002 | Watanabe et al. | 399/117 |
| 6,909,866 | B2 * | 6/2005 | Kawai | 399/167 |
| 7,006,776 | B2 * | 2/2006 | Matsuzaka et al. | 399/111 |
| 2003/0059233 | A1 * | 3/2003 | Jang et al. | 399/167 |
| 2004/0009007 | A1 * | 1/2004 | Carter et al. | 399/113 |
| 2005/0191090 | A1 * | 9/2005 | Nishimura | 399/113 |
| 2005/0214023 | A1 * | 9/2005 | Foster et al. | 399/111 X |

FOREIGN PATENT DOCUMENTS

| | | |
|---|---|---|
| JP | Y2 7-33253 | 7/1995 |
| JP | B2 2575759 | 11/1996 |
| JP | A 11-167335 | 6/1999 |
| JP | A 11-224040 | 8/1999 |
| JP | A 2000-221863 | 8/2000 |
| JP | A 2002-149037 | 5/2002 |
| JP | A 2003-280489 | 10/2003 |

* cited by examiner

*Primary Examiner*—Sophia S. Chen
(74) *Attorney, Agent, or Firm*—Oliff & Berridge, PLC

(57) ABSTRACT

An image-forming device includes: a cartridge receiving portion; a drive engaging unit; and a coupling member. The cartridge receiving portion receives a process cartridge detachably mounted therein. The drive engaging unit can move between an engaged position, in which the drive engaging unit transfers a driving force to the process cartridge, and a disengaged position, in which the drive engaging unit fails to transfer a driving force to the process cartridge. The coupling member moves the drive engaging unit between the engaged position and the disengaged position in association with mounting and detaching of the process cartridge in the cartridge receiving portion.

22 Claims, 9 Drawing Sheets

RIGHT
FRONT
LEFT
1
2
27
28
29
40
41
46
65
66
67
68
72
86
91
95
(100)
98
401
81b
(18)
81a
(18)
82
83
84
85
87
88
89
90
92
93
94
102
103
104
105
106
107
108

IMAGE-FORMING DEVICE AND PROCESS CARTRIDGE

BACKGROUND OF THE INVENTION

1. Field of the Invention

The present invention relates to an image-forming device such as a laser printer, and a process cartridge detachably mountable in the image-forming device.

2. Description of Related Art

A process cartridge can be detachably mounted in an image-forming device such as a laser printer. The process cartridge is provided with: a photosensitive drum on which electrostatic latent images are formed based on image data; and a developing roller for developing the electrostatic latent images into toner images. When the process cartridge is mounted in this image-forming device, the photosensitive drum and developing roller are arranged in opposition to each other and are driven to rotate in prescribed directions. While the photosensitive drum rotates one revolution, an electrostatic latent image is formed on the surface of the drum. When the latent image comes into contact with the developing roller, toner is supplied from the developing roller onto the surface of the photosensitive drum, developing the latent image into a toner image. The developed toner image is then transferred onto paper as the paper is conveyed between the photosensitive drum and a transfer roller disposed in opposition to the photosensitive drum.

Since this type of process cartridge is not provided with its own driving source, a driving source provided in the main body of the image-forming device has to supply a driving force to the process cartridge for rotating the photosensitive drum and the developing roller. Specifically, when the process cartridge is mounted in the image-forming device, a rotary drive member-provided in the image-forming device is engaged with a rotating member in the process cartridge. The driving force of the driving source provided in the image-forming device is transferred to the rotating member via the rotary drive member.

However, when removing the process cartridge from the image-forming device, it is necessary to disengage the rotating member of the process cartridge from the rotary drive member. Hence, the rotary drive member in conventional image-forming devices has been configured to engage with and disengage from the rotating member of the process cartridge, as described in Japanese unexamined patent application publication No. 2002-149037, for example. In this image-forming device, a cover is provided over an opening in the main casing for mounting and removing the process cartridge, and the engaged state of the rotary drive member is switched in association with the opening and closing of the cover so that the rotary drive member is engaged when the cover is closed and disengaged when the cover is open. In other words, when the process cartridge is mounted in the image-forming device and the cover is closed, the rotary drive member is engaged with the rotating member of the process cartridge. When the cover is open, the rotary drive member is disengaged from the rotating members.

SUMMARY OF THE INVENTION

However, with the construction of the image-forming device disclosed in Japanese unexamined patent application publication No. 2002-149037, if the cover is opened during a printing operation, the rotary drive member is disengaged from the rotating member of the process cartridge while both members are rotating, running the risk of causing damage to or significant wear on the rotary drive member. Moreover, forming the rotary drive member with a high-strength material to prevent such damage to and wear on the rotary drive member will inevitably increase manufacturing costs.

In view of the foregoing, it is an object of the present invention to provide an image-forming device and a process cartridge, which are capable of interrupting the transfer of a drive force to the process cartridge when the process cartridge is being removed from the image-forming device and which are capable of preventing transfer of the drive force to the process cartridge from being interrupted while the process cartridge is operating in the image-forming device.

In order to attain the above and other objects, according to one aspect, the present invention provides an image-forming device including: a cartridge receiving portion; a drive engaging unit; and a coupling member. The cartridge receiving portion receives a cartridge detachably mounted therein. The drive engaging unit can move between an engaged position, in which the drive engaging unit transfers a driving force to the cartridge, and a disengaged position, in which the drive engaging unit fails to transfer a driving force to the cartridge. The coupling member moves the drive engaging unit between the engaged position and the disengaged position in association with mounting and detaching of the cartridge in the cartridge receiving portion.

According to another aspect, the present invention provides a cartridge detachably mountable in an image-forming device. The image-forming device includes a drive engaging unit and a coupling member. The drive engaging unit is capable of projecting and retracting between an engaged position, in which the drive engaging unit transfers a driving force to the cartridge, and a disengaged position, in which the drive engaging unit fails to transfer a driving force to the cartridge. The coupling member has a projecting portion that causes the drive engaging unit to project to the engaged position and a retracting portion that causes the drive engaging unit to retract to the disengaged position. The coupling member selectively engages the projecting portion and the retracting portion with the drive engaging unit. The cartridge includes: a driving-force receiving unit; and a contact portion. The driving-force receiving unit is capable of being engaged with the drive engaging unit in the engaged position to receive the driving force from the drive engaging unit. The contact portion contacts the coupling member, when the cartridge is mounted in the image-forming device, to cause the coupling member to engage the projecting portion with the drive engaging unit. The contact portion separates from the coupling member, when the cartridge is removed from the image-forming device, to cause the coupling member to engage the retracting portion with the drive engaging unit.

According to another aspect, the present invention provides a combination of an image-forming device and a cartridge detachably mountable in the image-forming device. The combination includes: an image-forming device; and a cartridge detachably mountable in the image-forming device. The image-forming device includes: a drive engaging unit; and a coupling member. The drive engaging unit is capable of projecting and retracting between an engaged position, in which the drive engaging unit transfers a driving force to the cartridge, and a disengaged position, in which the drive engaging unit fails to transfer a driving force to the cartridge. The coupling member has a projecting portion that causes the drive engaging unit to project to the engaged position and a retracting portion that causes the drive engaging unit to retract to the disengaged position. The coupling member selectively engages the projecting portion and the retracting portion with the drive engaging unit. The cartridge includes: a driving-force receiving unit; and a contact portion. The driving-force receiving unit is capable of being engaged with the drive engaging unit in the engaged position to receive the driving force from the drive engaging unit. The contact portion contacts the coupling member, when the cartridge is mounted in the image-forming device, to cause the coupling member to engage the projecting portion with the drive engaging unit, and separates from the coupling member, when the cartridge is removed from the image-forming device, to cause the coupling member to engage the retracting portion with the drive engaging unit.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
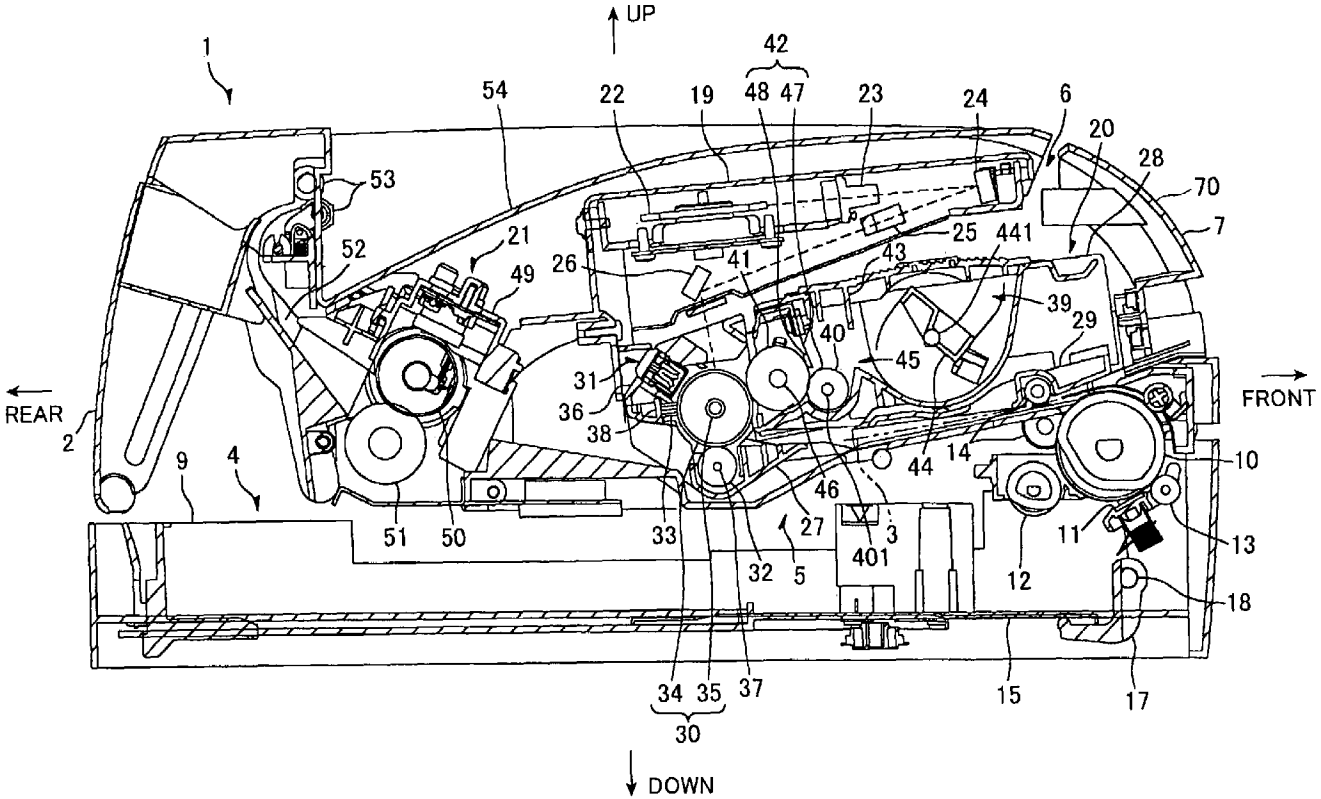
FIG. 1 is a side cross-sectional view showing a laser printer according to a preferred embodiment of the present invention with a front cover of the printer in a closed state.

An image-forming device and a process cartridge according to a preferred embodiment of the present invention will be described while referring to the accompanying drawings wherein like parts and components are designated by the same reference numerals to avoid duplicating description.

Figure 2:
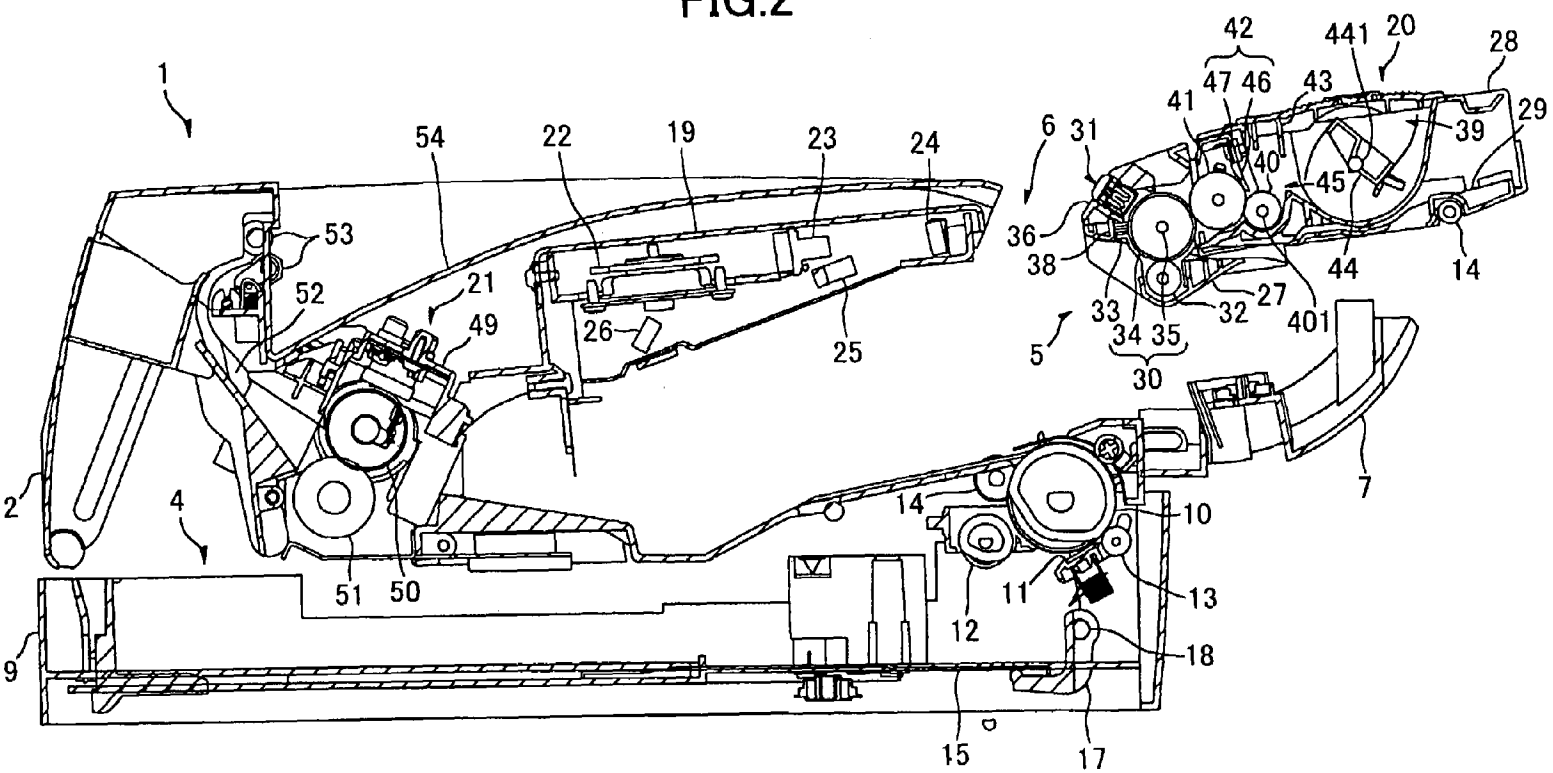
FIG. 2 is a cross-sectional view of the laser printer in FIG. 1 with the front cover in an open state.

FIGS. 1 and 2 are side cross-sectional views showing the relevant construction of a laser printer 1 according to the preferred embodiment.

As shown in the drawings, the laser printer 1 includes a main casing 2. Within the main casing 2, the laser printer 1 includes: a feeder unit 4 for feeding a paper 3; and an image-forming unit 5 for forming images on the paper 3 supplied from the feeder unit 4.

The laser printer 1 also includes an access opening 6 formed in one side wall of the main casing 2 for inserting and removing a process cartridge 20 described later, and a front cover 7 capable of opening and closing over the access opening 6. The front cover 7 is rotatably supported by a cover shaft (not shown) inserted through a bottom end of the front cover 7. Accordingly, when the front cover 7 is rotated closed about the cover shaft, the front cover 7 covers the access opening 6, as shown in FIG. 1. When the cover is rotated open about the cover shaft (rotated clockwise in FIG. 1), the access opening 6 is exposed, as shown in FIG. 2, enabling the process cartridge 20 to be mounted into or removed from the main casing 2 via the access opening 6. A control panel 70, including operating keys and an LED display unit, is embedded in the front cover 7.

A cover sensor 115 (see FIG. 3) is provided in the access opening 6 for detecting whether the front cover 7 is open or closed. The cover sensor 115 transmits a detection signal corresponding to the open and closed status of the front cover 7 to a CPU 114 described later.

Hereinafter, the side of the laser printer 1, on which the front cover 7 is provided (the upstream side with respect to the mounting direction of the process cartridge 20), will be referred to as the "front side" and the opposite side as the "rear side." The "upper", "lower", "right", and "left" of the laser printer 1 are defined with respect to the "front side" and the "rear side."

Similarly, the side of the process cartridge 20, which confronts the front side of the laser printer 1 when the process cartridge 20 is mounted in the laser printer 1, will be referred to as the "front side" and the opposite side as the "rear side." The "upper", "lower", "right", and "left" of the process cartridge 20 are defined with respect to the "front side" and the "rear side."

The feeder unit 4 includes a paper supply tray 9 that is detachably mounted in a lower section of the main casing 2, a feeding roller 10 and separating pad 11 disposed above the front end of the paper supply tray 9, a pickup roller 12 disposed on the rear side of the feeding roller 10, a pinch roller 13 disposed in opposition to the feeding roller 10 on the lower front side thereof, and a pair of registration rollers 14 disposed on the upper rear side of the feeding roller 10. The paper supply tray 9 can be removed from the laser printer 1 by moving the paper supply tray 9 forwardly through the front side of the laser printer 1.

A paper pressing plate 15 is provided inside the paper supply tray 9 for supporting the paper 3 in a stacked state. The paper pressing plate 15 is pivotably supported on the rear end thereof, so that the front end can move vertically. A lever 17 is provided in the front section of the paper supply tray 9 for lifting the front end of the paper pressing plate 15. The lever 17 has a substantially L-shaped cross section in order to bend around the front end of the paper pressing plate 15 and extend under the bottom surface of the paper pressing plate 15. The top end of the lever 17 is attached to a lever shaft 18 disposed on the front end of the paper supply tray 9, while the rear end of the lever 17 contacts the bottom surface of the paper pressing plate 15 near the front end thereof. When the lever shaft 18 is driven to rotate clockwise in the drawings, the lever 17 rotates about the lever shaft 18, and the rear end of the lever 17 lifts the front end of the paper pressing plate 15.

When the front end of the paper pressing plate 15 is lifted, the topmost sheet of the paper 3 stacked on the paper pressing plate 15 is pressed against the pickup roller 12. The pickup roller 12 rotates to begin conveying the topmost sheet of the paper 3 between the feeding roller 10 and separating pad 11.

However, when the paper supply tray 9 is removed from the main casing 2, the front end of the paper pressing plate 15 drops downward of its own accord and rests on the bottom surface of the paper supply tray 9. In this state, the paper 3 can be supported in a stacked form on the paper pressing plate 15.

When the pickup roller 12 conveys a sheet of the paper 3 toward a nip part between the feeding roller 10 and separating pad 11, the paper 3 becomes interposed between the feeding roller 10 and separating pad 11 by the rotation of the feeding roller 10 and is reliably separated and fed one sheet at a time. The separated sheet of paper 3 is fed between the feeding roller 10 and pinch roller 13 and conveyed to the registration rollers 14. After adjusting the registration of the paper 3, the registration rollers 14 convey the sheet of paper 3 to a transfer position in the image-forming unit 5 (a position between a photosensitive drum 30 and a transfer roller 32 described later), at which a toner image formed on the photosensitive drum 30 is transferred onto the paper 3.

The image-forming unit 5 includes a scanning unit 19, the process cartridge 20, and a fixing unit 21.

The scanning unit 19 is disposed in the top section of the main casing 2, and includes: a laser light source (not shown); a polygon mirror 22 that can be driven to rotate; a fθ lens 23; a reflecting mirror 24; a lens 25; and a reflecting mirror 26. The laser light source emits a laser beam based on image data. As illustrated by a dotted line in FIG. 1, the laser beam is deflected by the polygon mirror 22, passes through the fθ lens 23, and is reflected rearward by the reflecting mirror 24. After passing through the lens 25, the laser beam is reflected downward by the reflecting mirror 26 and irradiated on the surface of the photosensitive drum 30 described later in the process cartridge 20.

The process cartridge 20 is detachably mounted in the main casing 2 beneath the scanning unit 19. The process cartridge 20 includes: a drum cartridge 27; and a developer cartridge 28 that is detachably mounted on the drum cartridge 27.

The drum cartridge 27 includes a pair of side plates 29 (see FIG. 5) each extending in the front-to-rear direction and disposed in opposition to each other in a direction substantially orthogonal to the front-to-rear direction. (Hereinafter, the direction orthogonal to the front-to-rear direction will be referred to simply as the "widthwise direction.") The developer cartridge 28 is mounted on the front side of the drum cartridge 27 between the side plates 29. The drum cartridge 27 has a photosensitive drum 30, a Scorotron type charger 31, a transfer roller 32, and a cleaning brush 33 between the side plates 29 and on the rear side of the developer cartridge 28.

The photosensitive drum 30 includes: a main drum body 34 that is cylindrical in shape; and a metal drum shaft 35 extending along the axial center of the main drum body 34 in the longitudinal direction thereof. The main drum body 34 has, on its outer surface, a photosensitive layer formed of polycarbonate or the like that has a positively charging nature. The drum shaft 35 is fixedly secured to both of the side plates 29 of the drum cartridge 27. The drum shaft 35 is unable to rotate relative to the side plates 29. The main drum body 34 is rotatably supported on the drum shaft 35. With this construction, the photosensitive drum 30 is disposed between the side plates 29 and capable of rotating about the drum shaft 35.

The charger 31 is mounted on a charger mounting unit 36 spanning between the side plates 29 of the drum cartridge 27 diagonally above and rearward of the photosensitive drum 30. The charger 31 is disposed in opposition to but separate a prescribed distance from the photosensitive drum 30 so as not to contact the same. The charger 31 is a positively charging Scorotron charger that generates a corona discharge from a wire formed of tungsten or the like, and can form a uniform charge of positive polarity over the surface of the photosensitive drum 30.

The transfer roller 32 is rotatably supported on both side plates 29 of the drum cartridge 27 and opposes and contacts the bottom surface of the photosensitive drum 30 in a vertical direction so as to form a nip part with the photosensitive drum 30. The transfer roller 32 is configured of a metal roller shaft 37 that is covered with a roller formed of a conductive rubber material. During a transfer operation, a transfer bias is applied to the transfer roller 32. The cleaning brush 33 is mounted on a brush mounting unit 38 that spans between the side plates 29 of the drum cartridge 27 on the rear side of the photosensitive drum 30. The cleaning brush 33 is disposed so that a tip of the brush is in contact with the surface of the main drum body 34 of the photosensitive drum 30.

The developer cartridge 28 is formed in a box shape that is open on the rear side. Within the developer cartridge 28 are provided a toner accommodating chamber 39, a supply roller 40, a developing roller 41, and a thickness regulating blade 42. The developer cartridge 28 can be mounted together with the drum cartridge 27 as one unit (process cartridge 20) in the main casing 2. The developer cartridge 28 and the drum cartridge 27 can be removed as one unit from the main casing 2. It is also possible to mount and remove only the developer cartridge 28 with respect to the main casing 2 while the drum cartridge 27 is mounted in the main casing 2.

A partitioning plate 43 partitions a space in the front side of the developer cartridge 28 to form the toner accommodating chamber 39. The toner accommodating chamber 39 is filled with a nonmagnetic, single-component toner having a positive charging nature. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, and wax, as well as an additive such as silica to improve fluidity. The average diameter of the toner particles is about 6-10 μm.

A rotational shaft 441 is supported in the toner accommodating chamber 39 between the front portions of both side walls of the developer cartridge 28 opposing each other in the widthwise direction. An agitator 44 is provided on the rotational shaft 441. The agitator 44 stirs toner in the toner accommodating chamber 39, discharging toner through an opening 45 formed under the partitioning plate 43 toward the supply roller 40 in the front-to-rear direction.

The supply roller 40 is disposed rearward of the opening 45 and is supported between the rear portions of the both side walls of the developer cartridge 28 opposing each other in the widthwise direction. The supply roller 40 is configured of a metal roller shaft 401 that is covered by a roller formed of a conductive foam material.

The developing roller 41 is supported between rear ends of the both side walls of the developer cartridge 28 rearward of the supply roller 40 and contacts the supply roller 40 so that both are compressed by the force. The developing roller 41 is positioned so that a portion of the surface of the developing roller 41 on the opposite side from the supply roller 40 is exposed through the rear side of the developer cartridge 28. The developing roller 41 opposes and contacts the photosensitive drum 30 in the front-to-rear direction when the developer cartridge 28 is mounted on the drum cartridge 27. The developing roller 41 is configured of a metal roller shaft 46 covered by a roller that is formed of a conductive rubber material.

Figure 5:
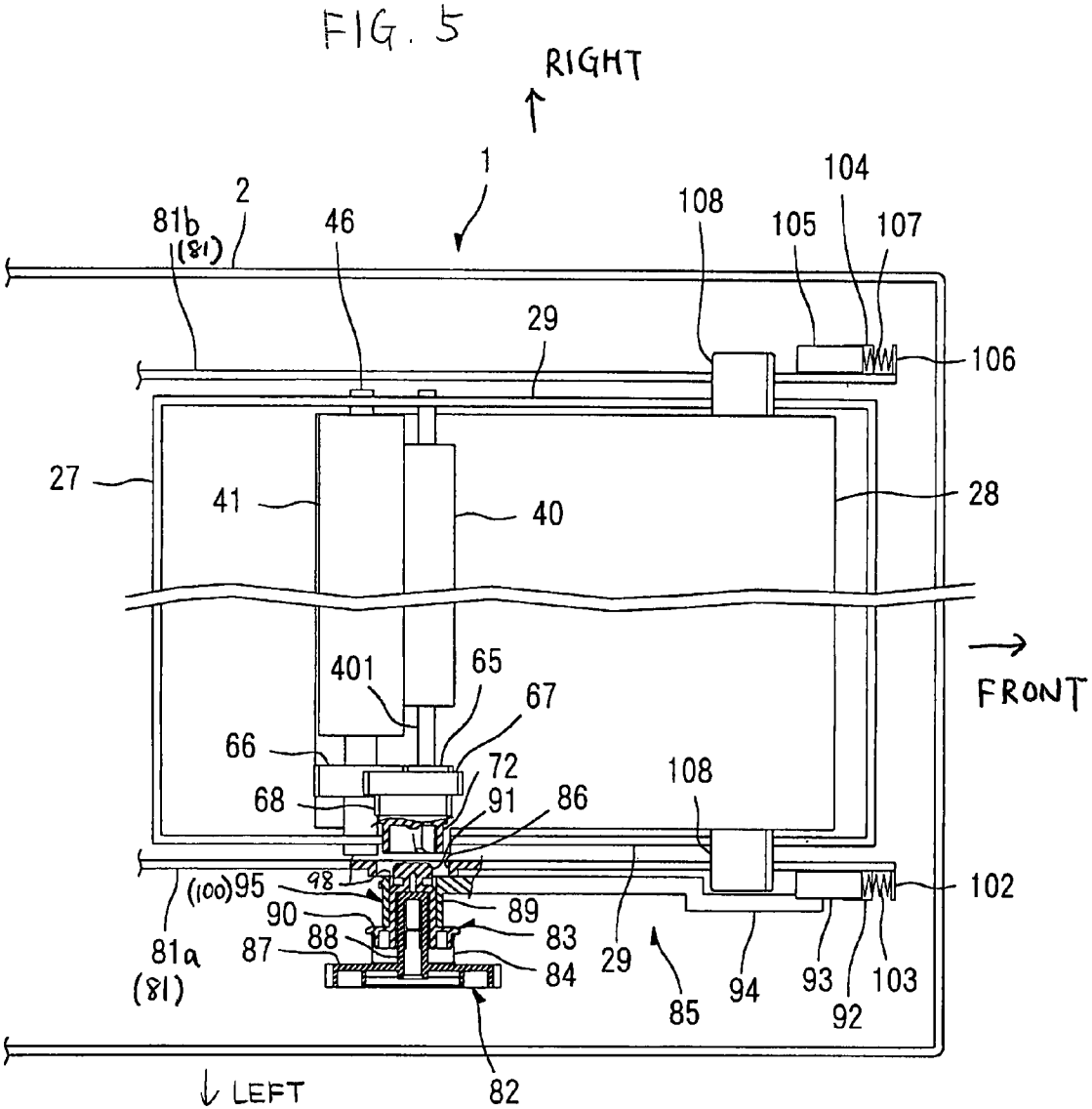
FIG. 5 is a plan view showing the developer cartridge of FIG. 4 in the detached state.

Both ends of the roller shaft 46 protrude outward in the widthwise direction from the both sidewalls of the developer cartridge 28 at the rear ends thereof (see FIG. 5). The roller of the developing roller 41 is configured of a main roller body formed of an electrically conductive urethane rubber or silicone rubber including fine carbon particles, the surface of which body is coated with a urethane rubber or silicone rubber including fluorine. During a developing operation, a developing bias is applied to the developing roller 41.

The thickness regulating blade 42 includes a main blade member 47 configured of a metal leaf spring member and a pressing portion 48 provided on the end of the main blade member 47. The pressing portion 48 has a semicircular cross section and is formed of an insulating silicone rubber. The thickness regulating blade 42 is supported on the developer cartridge 28 above the developing roller 41. With this construction, the elastic force of the main blade member 47 causes the pressing portion 48 to contact the surface of the developing roller 41 with pressure.

Toner discharged through the opening 45 is supplied onto the developing roller 41 by the rotating supply roller 40. At this time, the toner is positively tribocharged between the supply roller 40 and developing roller 41. As the developing roller 41 rotates, toner supplied to the surface of the developing roller 41 passes between the developing roller 41 and the pressing portion 48 of the thickness regulating blade 42, thereby maintaining a uniform thickness of toner on the surface of the developing roller 41.

Figure 3:
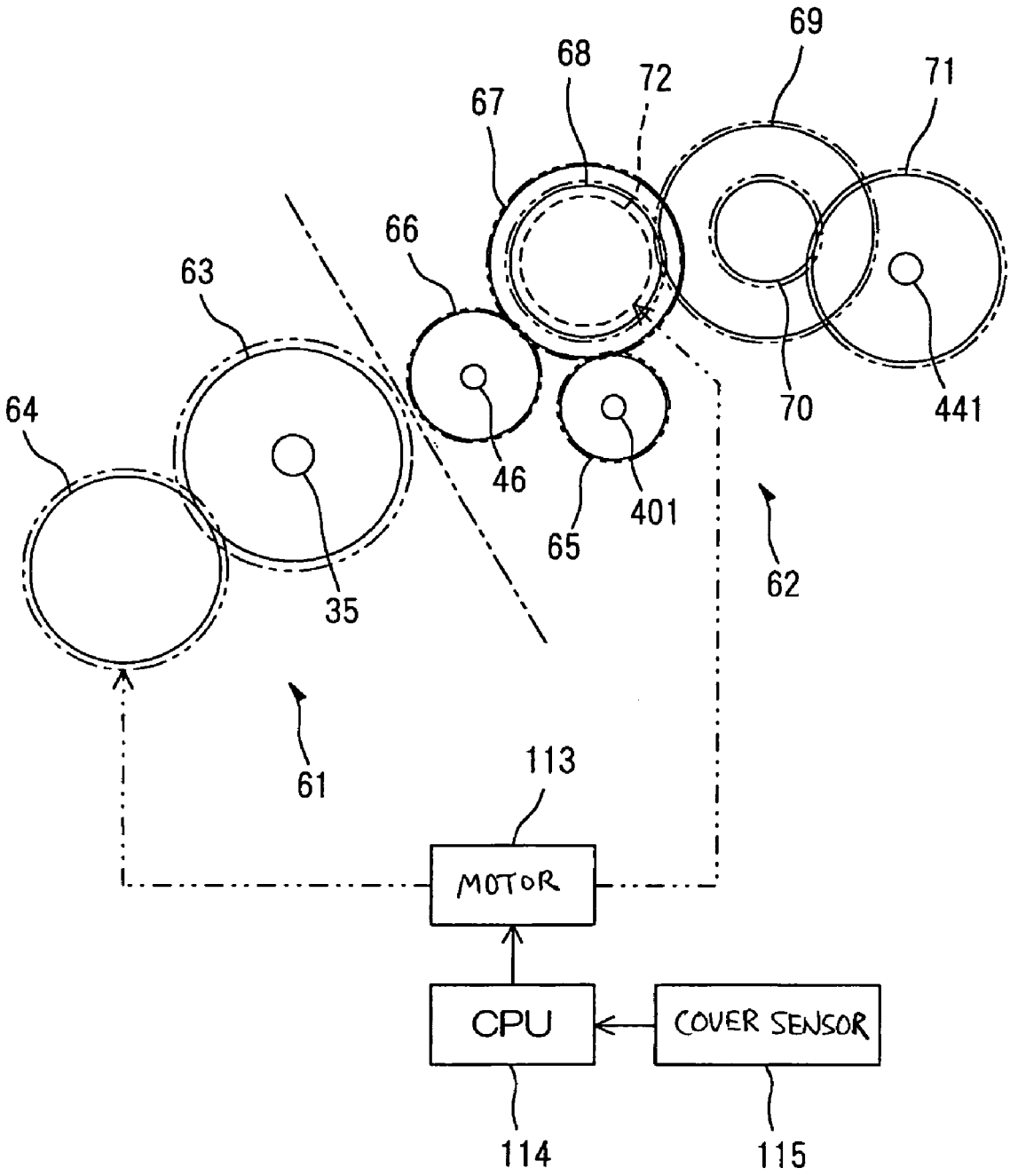
FIG. 3 is an explanatory diagram illustrating drive transfer mechanisms for the photosensitive drum and developer cartridge shown in FIG. 1.

In addition, a drum drive transfer mechanism 61 and a developer drive transfer mechanism 62 are disposed on one side wall (left side wall) of the process cartridge 20 as shown in FIG. 3. The drum drive transfer mechanism 61 is for driving the photosensitive drum 30 to rotate. The developer drive transfer mechanism 62 is for driving the developing roller 41 and the agitator 44 to rotate.

The drum drive transfer mechanism 61 includes a drum gear 63 and a drum drive gear 64. The drum gear 63 is rotatably supported on the drum shaft 35, but is fixed to the main drum body 34. The drum gear 63 is therefore unable to rotate relative to the main drum body 34. The drum gear 63 is able to rotate integrally with the main drum body 34. The drum drive gear 64 is engaged with the drum gear 63.

When the process cartridge 20 is mounted in the main casing 2, an input gear (not shown) provided inside the main casing 2 engages with the drum drive gear 64. A motor 113 is also disposed in the main casing 2 so that a drive force from the motor 113 is inputted to the drum drive gear 64 via the input gear. The drive force inputted into the drum drive gear 64 is transferred to the drum gear 63 for driving the main drum body 34 to rotate together with the drum gear 63.

The developer drive transfer mechanism 62 includes: a supply roller gear 65; a developer roller gear 66; a first idle gear 67; a second idle gear 68; a third idle gear 69; a fourth idle gear 70; an agitator gear 71; and a female coupling member 72. The supply roller gear 65 is coupled directly with the roller shaft 401 of the supply roller 40. The developer roller gear 66 is coupled directly with the roller shaft 46 of the developing roller 41. The first idle gear 67 is engaged with both the supply roller gear 65 and the developer roller gear 66. The second idle gear 68 is provided coaxially with the first idle gear 67 but has a smaller diameter than the first idle gear 67. The third idle gear 69 is engaged with the second idle gear 68. The fourth idle gear 70 is provided coaxially with the third idle gear 69 but has a smaller diameter than the third idle gear 69. The agitator gear 71 is directly coupled with the rotational shaft 441 of the agitator 44 and is engaged with the fourth idle gear 70. The female coupling member 72 is disposed coaxially with the first idle gear 67 and second idle gear 68, and is for engaging with a male coupling member 83 described later (see FIGS. 5 and 6). The female coupling member 72 is coupled directly with the first idle gear 67 and second idle gear 68.

Figure 4:
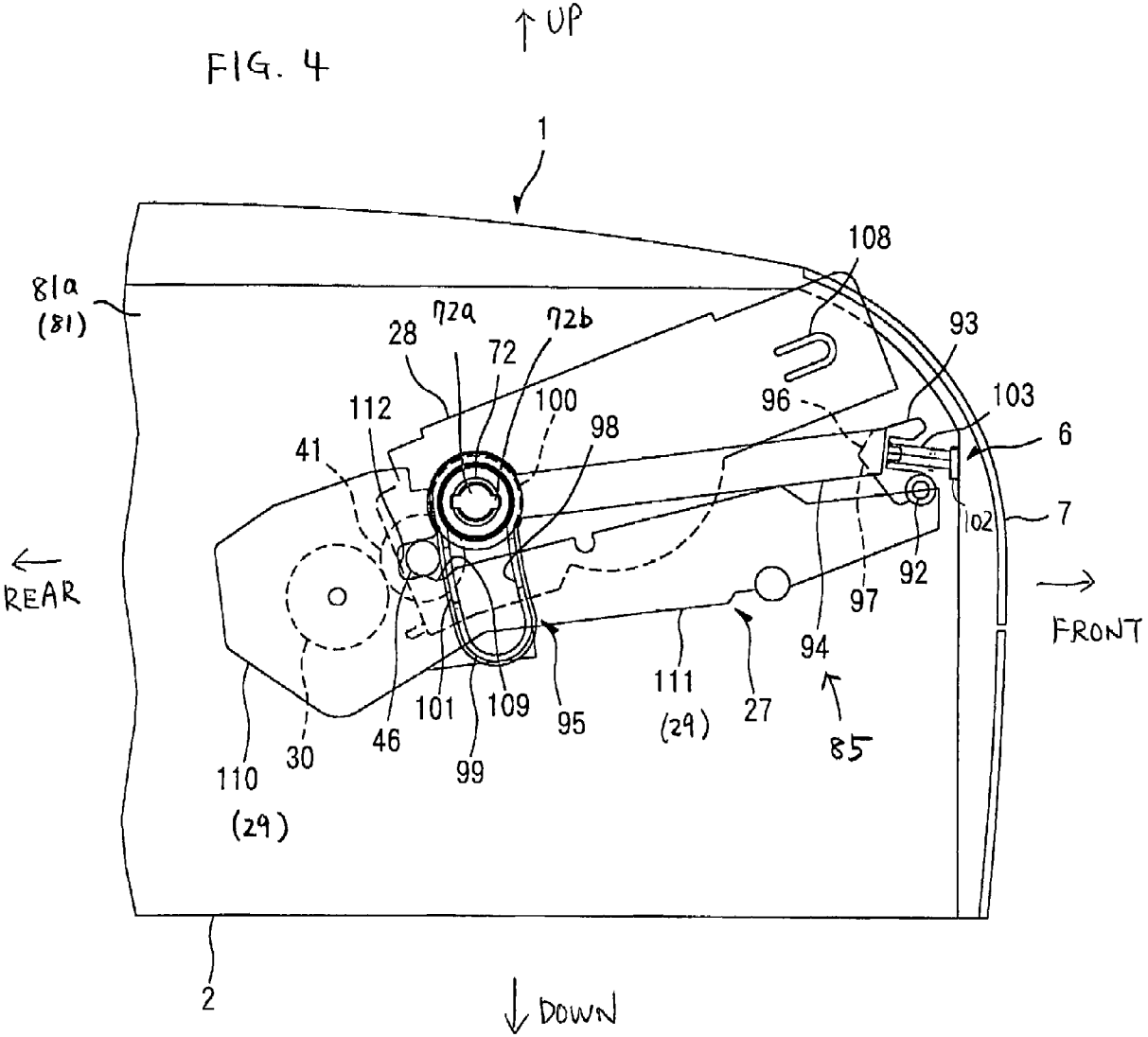
FIG. 4 is a side cross-sectional view showing the developer cartridge of FIG. 1 in a detached state.
Figure 7:
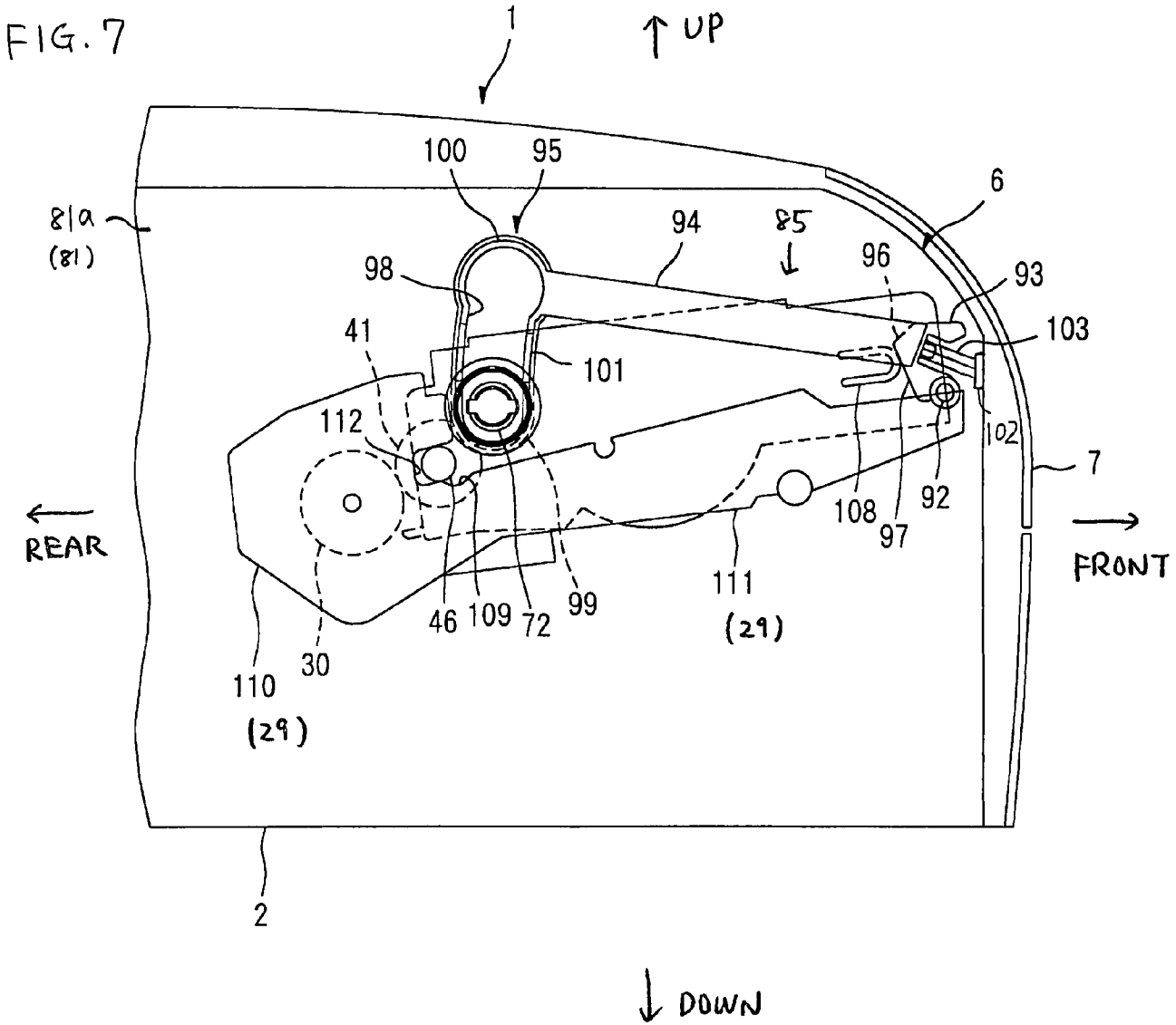
FIG. 7 is a side cross-sectional view showing the developer cartridge of FIG. 1 in a mounted state.

As shown in FIGS. 4 and 7, the female coupling member 72 is disposed diagonally above and forward of the roller shaft 46 of the developing roller 41. When the process cartridge 20 is mounted in the main casing 2, the male coupling member 83 couples with the female coupling member 72, enabling a driving force from the motor 113 to be inputted into the female coupling member 72 via the male coupling member 83. The driving force inputted into the female coupling member 72 rotates the first idle gear 67 and second idle gear 68 together with the female coupling member 72. Rotation of the first idle gear 67 causes the supply roller gear 65 and developer roller gear 66 to rotate, which in turn rotate the supply roller 40 and developing roller 41 (see FIG. 1). Rotation of the second idle gear 68 causes the third idle gear 69 to rotate, which in turn rotates the fourth idle gear 70 together with the third idle gear 69. The rotation of the fourth idle gear 70 is transferred to the agitator gear 71 and the agitator gear 71 rotates the agitator 44 (see FIG. 1).

The laser printer 1 is also provided with the CPU 114, as shown in FIG. 3. The CPU 114 is connected to the cover sensor 115. The cover sensor 115 inputs detection signals to the CPU 114 according to the open and closed states of the front cover 7. The CPU 114 is also connected to the motor 113 and controls driving of the motor 113 via a motor driver (not shown).

As the photosensitive drum 30 rotates, the charger 31 charges the surface of the photosensitive drum 30 with a uniform positive polarity. Subsequently, a laser beam emitted from the scanning unit 19 is scanned at a high speed over the surface of the photosensitive drum 30, forming an electrostatic latent image corresponding to an image that is desired to be formed on the paper 3.

Next, positively charged toner carried on the surface of the developing roller 41 comes into contact with the photosensitive drum 30 as the developing roller 41 rotates, and is supplied to areas on the surface of the positively charged photosensitive drum 30 that have been exposed to the laser beam and, therefore, that have a lower potential. In this way, the latent images on the photosensitive drum 30 are transformed into visible images so that a reverse toner image is carried on the surface of the photosensitive drum 30.

When the registration rollers 14 convey the paper 3 to a transfer position between the photosensitive drum 30 and transfer roller 32, the toner image carried on the surface of the photosensitive drum 30 is transferred onto the paper 3 by a transfer bias applied to the transfer roller 32. After the toner image is transferred, the paper 3 is conveyed to the fixing unit 21. Toner remaining on the photosensitive drum 30 after the transfer operation is recovered by the developing roller 41. Further, paper dust deposited on the photosensitive drum 30 from the paper 3 is recovered by the cleaning brush 33 after the transfer operation.

The fixing unit 21 is disposed on the rear side of the process cartridge 20 and includes a frame 49, and a heating roller 50 and a pressure roller 51 provided within the frame 49.

The heating roller 50 includes a metal tube and a halogen lamp disposed inside the tube for heating the same. The heating roller 50 is driven to rotate by a driving force inputted from the motor 113 (see FIG. 3).

The pressure roller 51 is disposed below and in opposition to the heating roller 50 and contacts the heating roller 50 with pressure. The pressure roller 51 is configured of a metal roller shaft covered with a roller that is formed of a rubber material. The pressure roller 51 follows the rotational drive of the heating roller 50.

In the fixing unit 21, toner transferred onto the paper 3 at the transfer position is fixed to the paper 3 by heat as the paper 3 passes between the heating roller 50 and pressure roller 51. After the fixing process, the paper 3 is conveyed along a discharge path 52 that leads up to the top surface of the main casing 2. Discharge rollers 53 provided at the top of the discharge path 52 discharge the paper 3 onto a discharge tray 54 formed on the top surface of the main casing 2.

As shown in FIGS. 4 through 9, the laser printer 1 also includes, within the main casing 2: a pair of frames 81 (left frame 81*a* and a right frame 81*b*); a developer drive gear 82; the male coupling member 83; an urging spring 84; and a coupling mechanism 85. The pair of frames 81 (81*a* and 81*b*) oppose each other in the widthwise direction on either side of the process cartridge 20. The developer drive gear 82 is disposed on the outside (left side) of the left frame 81*a* in the widthwise direction for receiving a driving force from the motor 113 (see FIG. 3). The male coupling member 83 rotates together with the developer drive gear 82. The urging spring 84 is for urging the male coupling member 83 in a direction (rightward direction) toward the left frame 81*a*. The coupling mechanism 85 is disposed on the outer surface (left side surface) of the left frame 81*a*.

Figure 8:
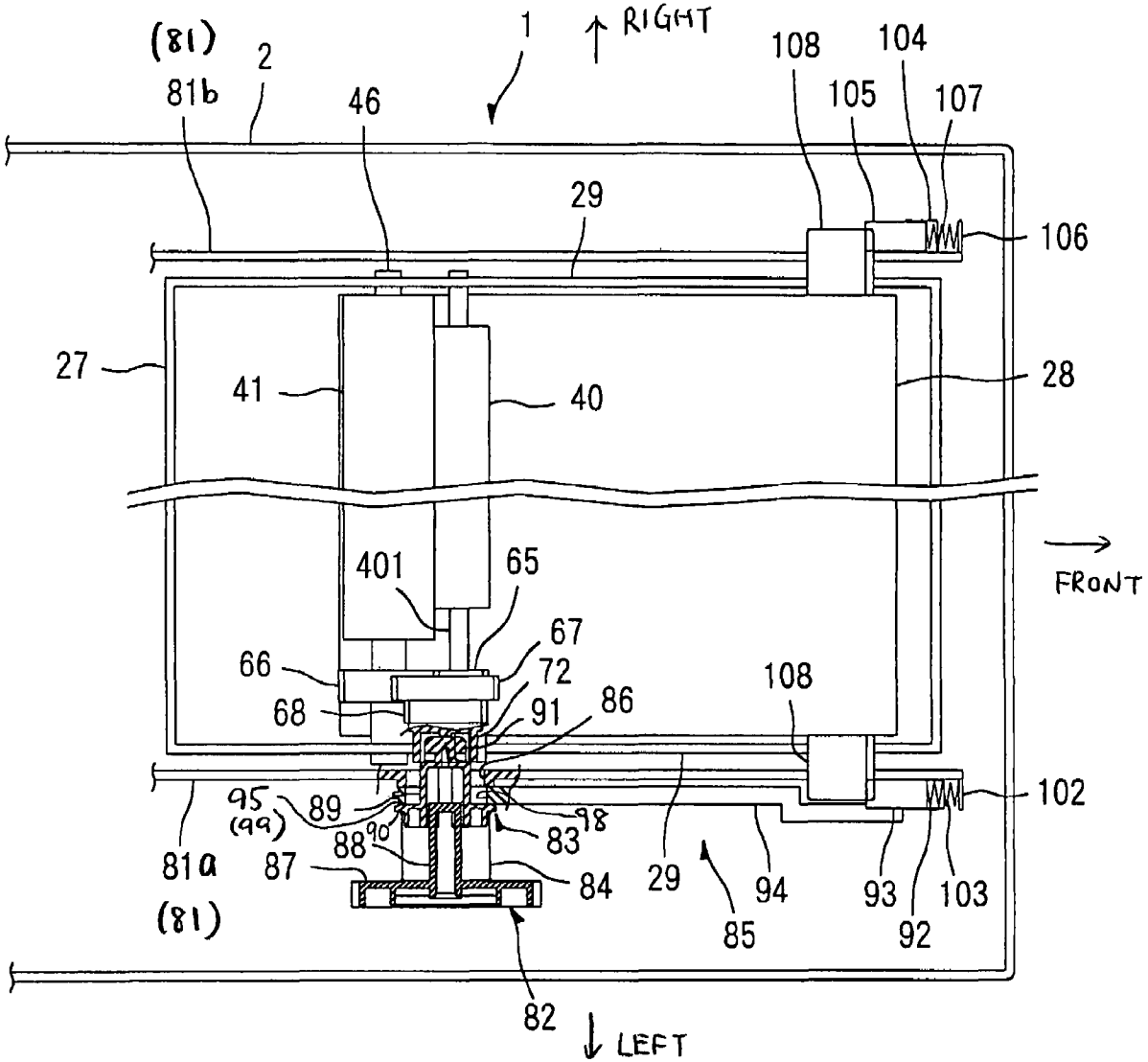
FIG. 8 is a plan view showing the developer cartridge of FIG. 7 in the mounted state.

As shown in FIGS. 5 and 8, the frames 81 extend in the front-to-rear direction. When the process cartridge 20 is mounted in the laser printer 1, the frames 81 oppose but are separate a prescribed distance from the outer sides of the side plates 29 in the drum cartridge 27 with respect to the widthwise direction. Further, an insertion through-hole 86 is formed in the left frame 81*a* for receiving the male coupling member 83 inserted therein.

The developer drive gear 82 includes a gear portion 87 and a connecting portion 88. The gear portion 87 has a disk shape. The connecting portion 88 extends along the central axis of the gear portion 87 from the gear portion 87. The gear portion 87 opposes and is separate a prescribed distance from the outer side (left side) of the left frame 81*a* in the widthwise direction, with the connecting portion 88 extending from the gear portion 87 toward the left frame 81*a*. Numerous gear teeth are formed on the outer peripheral surface of the gear portion 87 for engaging with a transfer gear (not shown), which serves to transfer a driving force from the motor 113.

The male coupling member 83 includes: an insertion portion 89; a flange 90; and a coupling portion 91, which are integrated together into the male coupling member 83. The connecting portion 88 of the developer drive gear 82 is slidably inserted in the insertion portion 89 in an insertion direction that is parallel to the widthwise direction. The insertion portion 89 prevents the relative rotation between the insertion portion 89 and the connecting portion 88. Thus, the insertion portion 89 prevents the relative rotation between the developer drive gear 82 and the male coupling member 83.

The flange 90 is formed on a base end of the insertion portion 89 on the developer drive gear 82 side. The coupling portion 91 is disposed on the other end part the insertion portion 89 opposite to the flange 90. The coupling portion 91 is for coupling with the female coupling member 72 while preventing relative rotation between the coupling portion 91 and the female coupling member 72. The coupling portion 91 can prevent relative rotation between the male coupling member 83 and the female coupling member 72.

More specifically, as shown in FIG. 4, the female coupling member 72 has, on its tip end (left side end), a central recess 72*a* and a pair of grooves 72*b*. The central recess 72*a* is of a circular shape. The pair of grooves 72*b* are formed continuous from the central recess 72*a*, and extend radially outwardly in directions opposite from each other. The coupling portion 91 is formed as a protrusion whose shape substantially matches with the composite shape of the recess 72*a* and the pair of grooves 72*b*.

The male coupling member 83 can shift between a disengaged position shown in FIG. 5, at which the end of the coupling portion 91 is disposed within the insertion through-hole 86 formed in the left frame 81*a*, and an engaged position shown in FIG. 8, at which the coupling portion 91 penetrates the insertion through-hole 86 and protrudes into the path for mounting and removing the developer cartridge 28 (process cartridge 20) and is engaged with the female coupling member 72.

The urging spring 84 is configured of a compression spring, and is interposed between the gear portion 87 of the developer drive gear 82 and the flange 90 of the male coupling member 83, and urges the male coupling member 83 in a direction (rightward direction) toward the engaged position.

As shown in FIGS. 4 and 7, the coupling mechanism 85 includes: a rotational shaft 92; a locking pawl 93; an arm 94; and a cam 95. The rotational shaft 92 extends outward (leftward) from the front end of the left frame 81*a* in the widthwise direction. The locking pawl 93 is rotatably supported on the rotational shaft 92. The arm 94 extends rearward from the locking pawl 93. The cam 95 is formed on the rear end of the arm 94.

When viewed from the left side, as shown in FIGS. 4 and 7, the locking pawl 93 is shaped substantially like the letter C. A bottom end of the locking pawl 93 is rotatably supported on the rotational shaft 92. The locking pawl 93 includes a conversion surface 96 and a pressing surface 97. The conversion surface 96 is for contacting an operating piece 108 while the developer cartridge 28 is being mounted in the main casing 2 and converting the force received from the operating piece 108 into a forward rotating force so that the locking pawl 93 rotates clockwise in FIGS. 4 and 7 about the rotational shaft 92. The pressing surface 97 forms a near right angle with the conversion surface 96 when viewed from the left side. The pressing surface 97 is for contacting the operating piece 108 when the developer cartridge 28 is mounted in the main casing 2 and pressing the operating piece 108 rearward.

The front end of the arm 94 is fixed to the locking pawl 93. Hence, when the locking pawl 93 rotates about the rotational shaft 92, the rear end of the arm 94 moves vertically. That is, when the locking pawl 93 rotates clockwise from the state shown in FIG. 4 to the state shown in FIG. 7, the rear end of the arm 94 moves upwardly. On the other hand, when the locking pawl 93 rotates counterclockwise from the state shown in FIG. 7 to the state shown in FIG. 4, the rear end of the arm 94 moves downwardly.

As shown in FIGS. 4 through 9, the cam 95 extends in a vertical direction substantially orthogonal to the arm 94. When the developer cartridge 28 is mounted in the main casing 2, the flange 90 of the male coupling member 83 opposes the female coupling member 72 of the developer cartridge 28 in the widthwise direction, with the cam 95 being interposed between the flange 90 and the female coupling member 72.

A through-hole 98 is formed through the cam 95. The insertion portion 89 of the male coupling member 83 is inserted into the through-hole 98. The through-hole 98 is elongated, as shown in FIGS. 4 and 7, along a path that is traced by the rear end of the arm 94 when the arm 94 pivots about the rotational shaft 92.

Figure 6:
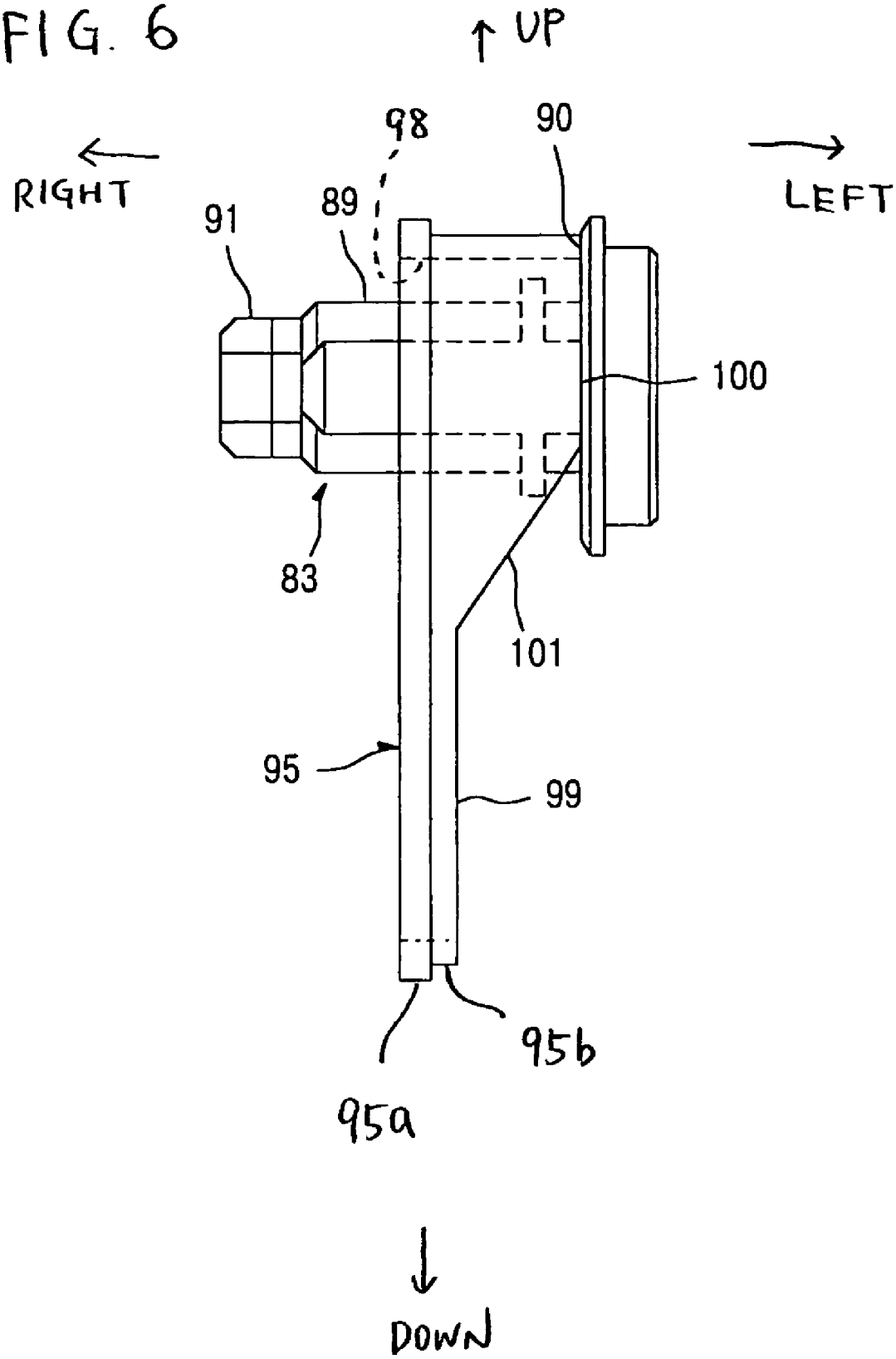
FIG. 6 is a rear view showing the state of FIGS. 4 and 5, in which a male coupling member contacts a retracting part.
Figure 9:
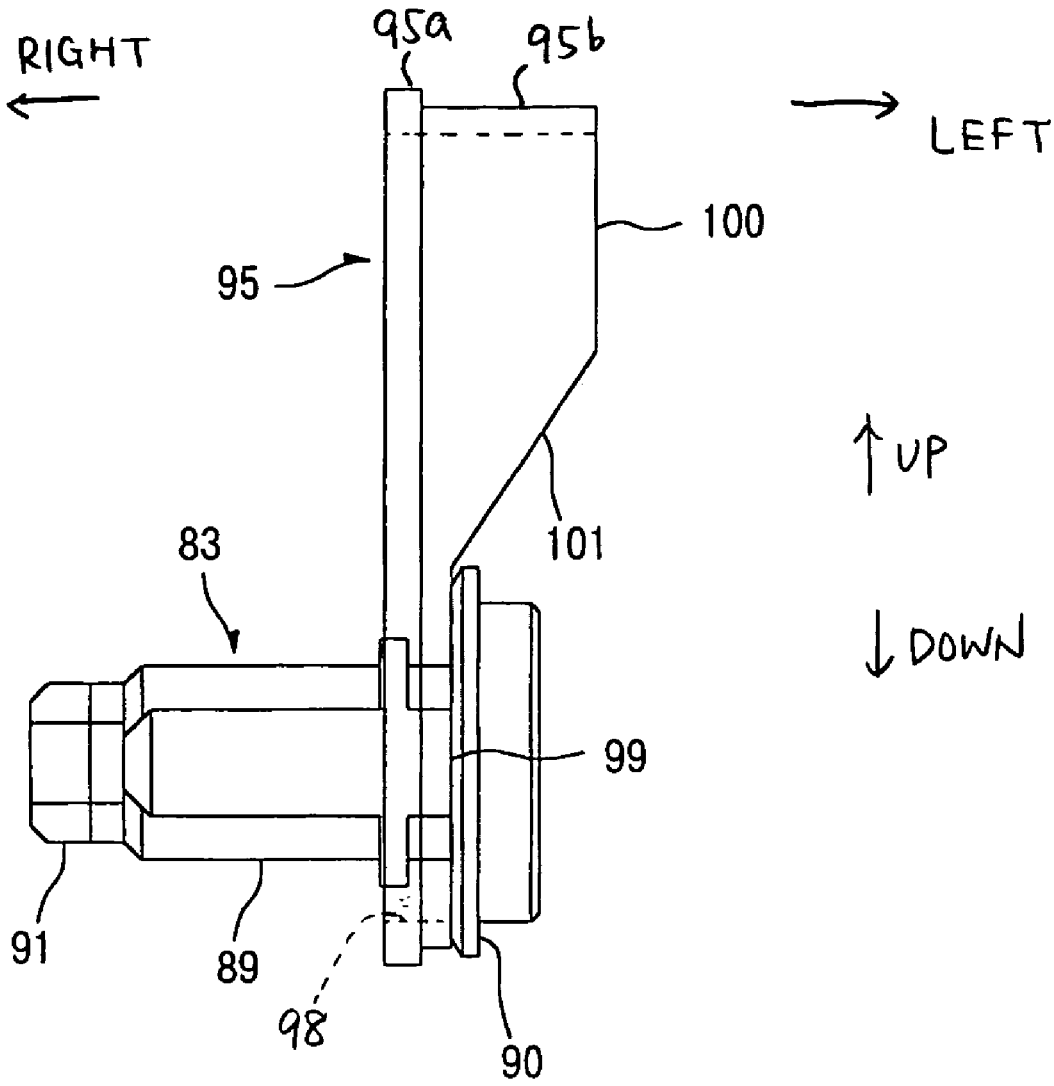
FIG. 9 is a rear view showing the state of FIGS. 7 and 8, in which the male coupling member contacts a projecting part.

As shown in FIGS. 6 and 9, the cam 95 includes a base plate 95*a* and a cam portion 95*b*. The base plate 95*a* has inner and outer side surfaces (right and left side surfaces) that are respectively continuous from inner and outer side surfaces (right and left side surfaces) of the arm 94. The base plate 95*a* has a uniform thickness, in the widthwise direction, that is equal to the thickness of the arm 94.

The cam portion 95*b* is provided on the outer side (left side) surface of the base plate 95*a*. The through-hole 98 is formed through both of the base plate 95*a* and the cam portion 95*b*. The base plate 95*a* and the cam portion 95*b* define the periphery of the elongated through-hole 98.

As shown in FIGS. 6 and 9, the cam portion 95*b* includes a projecting part 99, a retracting part 100, and a slanted part 101. The projecting part 99 is located at the lower end of the cam portion 95*b*, the retracting part 100 is located at the upper end of the cam portion 95*b*, and the slanted part 101 connects the projecting part 99 with the retracting part 100.

The projecting part 99, retracting part 100, and slanted part 101 each protrude outward (leftward) from the base plate 95*a* in the widthwise direction, while surrounding the through-hole 98. The projecting part 99 has a first widthwise thickness of a sufficiently small value that allows the male coupling member 83 to advance toward the developer cartridge 28. The retracting part 100 has a second widthwise thickness of a sufficiently large value that is greater than the value of the first thickness and that restricts the male coupling member 83 from advancing toward the developer cartridge 28. The slanted part 101 has a widthwise thickness that increases gradually from the projecting part 99 toward the retracting part 100.

When the developer cartridge 28 is being mounted in the main casing 2, the arm 94 pivots around the rotational shaft 92. As the arm 94 pivots around the rotational shaft 92, a selected one from among the projecting part 99, retracting part 100, and slanted part 101 is interposed between the female coupling member 72 of the developer cartridge 28 and the flange 90 of the male coupling member 83. Accordingly, as the arm 94 pivots around the rotational shaft 92, the outer side (left side) surfaces of the projecting part 99, retracting part 100, and slanted part 101 selectively contact the flange 90 of the male coupling member 83.

When the arm 94 is in the rotational position shown in FIG. 4, the flange 90 is in contact with the retracting part 100 as shown in FIG. 6. That is, as shown in FIG. 5, the male coupling member 83 is retracted as a whole outward (leftward) in the widthwise direction against the urging force of the urging spring 84, and therefore is in a disengaged state from the female coupling member 72.

When the arm 94 is in the rotational position shown in FIG. 7, the flange 90 is in contact with the projecting part 99 as shown in FIG. 9. That is, as shown in FIG. 8, the male coupling member 83 projects as a whole inward (rightward) in the widthwise direction by the urging force of the urging spring 84, and therefore is firmly engaged with the female coupling member 72.

Although not shown, when the arm 94 is in the rotational position between the rotational positions of FIGS. 4 and 7, the flange 90 is in contact with the slanted part 101, and therefore the male coupling member 83 is slightly engaged with the female coupling member 72.

As shown in FIGS. 5 and 8, a spring mounting plate 102 and a locking spring 103 are provided in the main casing 2. The spring mounting plate 102 is disposed on the front end of the left frame 81*a*. The locking spring 103 is interposed between the spring mounting plate 102 and the locking pawl 93, and is for urging the locking pawl 93 in a direction to place the retracting part 100 of the cam 95 in opposition to the flange 90 of the male coupling member 83.

With this construction, when the developer cartridge 28 is not mounted in the main casing 2 and the operating piece 108 described later is not in contact with the locking pawl 93, as shown in FIG. 4, the locking spring 103 urges the locking pawl 93 rearward, causing the arm 94 to be positioned at a slant, angling downward from the front end to the rear end. At this time, the flange 90 of the male coupling member 83 is in contact with the retracting part 100 as shown in FIG. 6.

As shown in FIGS. 5 and 8, the laser printer 1 also includes a rotational shaft 104, a locking pawl 105, a spring mounting plate 106, and a locking spring 107. The rotational shaft 104 extends outward (rightward) from the front end of the right frame 81*b* in the widthwise direction. The locking pawl 105 is rotatably supported on the rotational shaft 104. The spring mounting plate 106 is disposed on the front end of the right frame 81*b*. The locking spring 107 is interposed between the spring mounting plate 106 and locking pawl 105. The rotational shaft 104, locking pawl 105, spring mounting plate 106, and locking spring 107 are disposed on the right side of the mounting path for the developer cartridge 28 and have a symmetrical construction to the rotational shaft 92, locking pawl 93, spring mounting plate 102, and locking spring 103 disposed on the left side of the mounting path. It is noted that the locking pawl 105 has the same structure with the locking pawl 93, and therefore has the conversion surface 96 and pressing surface 97 in the same manner as the locking pawl 93.

Operating pieces 108 are formed on the front end of both side walls of the developer cartridge 28 and protrude outward in the widthwise direction. From a side view, as shown in FIGS. 4 and 7, the operating pieces 108 have a U-shape, with the bottom of the U pointing forward.

As shown in FIGS. 4 and 7, receiving portions 112 are formed on the both side plates 29 of the drum cartridge 27. The receiving portions 112 are for receiving both ends of the roller shaft 46 and for positioning the roller shaft 46 with respect to the side plates 29. Movement allowing portions 109 are also formed on the side plates 29. The movement allowing portions 109 are for allowing both ends of the roller shaft 46 to move when detaching the developer cartridge 28.

Each side plate 29 includes a support portion 110 and an extended portion 111. The support portions 110 on the side plates 29 of both sides support the photosensitive drum 30, charger 31, transfer roller 32, and cleaning brush 33 therebetween. On each side plate 29, the extended portion 111 extends forward from the support portion 110. The receiving portion 112 is formed as a depression extending rearward from the front end of the support portion 110. The movement allowing portion 109 is formed in the top edge of the extended part 111 near the rear end thereof. The movement allowing portion 109 is formed as a depression extending downward and forward continuously from the front bottom edge of the receiving portion 112.

When the drum cartridge 27 is mounted in the main casing 2, as shown in FIG. 4, the developer cartridge 28 can be introduced into the main casing 2 through the access opening 6 with the rear end of the developer cartridge 28 angled downward. Both ends of the roller shaft 46 protruding outward from the sides of the developer cartridge 28 are fitted into the receiving portions 112 to position the roller shaft 46 relative to the drum cartridge 27. Subsequently, the developer cartridge 28 is completely mounted on the drum cartridge 27 by pushing the front end of the developer cartridge 28 downward so that the developer cartridge 28 pivots about the roller shaft 46.

While the front end of the developer cartridge 28 is being pushed downward, the operating pieces 108 contact the conversion surfaces 96 of the locking pawls 93 and 105. The operating pieces 108 force the locking pawls 93 and 105 to rotate clockwise in FIG. 4 against the urging force of the locking springs 103 and 107. The arm 94 rotates together with the locking pawl 93. As a result, the rear end of the arm 94 rises upward, separating the retracting part 100 of the cam 95 from the male coupling member 83, enabling the cam 95 to move, with the male coupling member 83 sliding over the slanted part 101. Mounting of the developer cartridge 28 is complete when the pressing surfaces 97 of the locking pawls 93 and 105 contact the operating pieces 108.

When the pressing surfaces 97 of the locking pawls 93 and 105 contact the operating pieces 108, as shown in FIG. 7, the arm 94 is disposed at a slant angling upward from the front end to the rear end. As shown in FIG. 9, the projecting part 99 contacts or engages with the flange 90 of the male coupling member 83, and the urging spring 84 urges the male coupling member 83 inward (rightward) in the widthwise direction. Accordingly, the male coupling member 83 projects to the engaged position, at which the male coupling member 83 is engaged with the female coupling member 72. Accordingly, the coupling portion 91 of the male coupling member 83 is coupled with the female coupling member 72 of the developer cartridge 28, and prevents rotation of the female coupling member 72 relative to the male coupling member 83. A driving force generated by the motor 113 (see FIG. 3) can be transferred to the female coupling member 72 via the developer drive gear 82 and male coupling member 83.

Because the pressing surfaces 97 of the locking pawls 93 and 105 contact the operating pieces 108, the urging force of the locking springs 103 and 107 cause the locking pawls 93 and 105 to press rearward against the operating pieces 108, preventing the developer cartridge 28 from being detached from the drum cartridge 27.

When the user desires to remove the developer cartridge 28 from the main casing 2, the user opens the front cover 7 and lifts the front end of the developer cartridge 28. When the front cover 7 is opened, the cover sensor 115 detects the open state of the front cover 7 and transmits to the CPU 114 a detection signal indicating that the front cover 7 is open. In response to the detection signal, the CPU 114 forcibly halts driving of the motor 113. When the user subsequently raises the front end of the developer cartridge 28, the operating pieces 108 rotate the locking pawls 93 and 105 counterclockwise in FIG. 7 against the urging force of the locking springs 103 and 107.

The arm 94 rotates together with the rotation of the locking pawl 93 so that the rear end of the arm 94 lowers. The rotation of the arm 94 separates the projecting part 99 from the male coupling member 83 and moves the cam 95 so that the male coupling member 83 slides along the slanted part 101 toward the retracting part 100. When the locking pawls 93 and 105 are subsequently separated from the operating pieces 108, the retracting part 100 contacts the male coupling member 83 as shown in FIG. 6, moving the male coupling member 83 to the disengaged position at which the male coupling member 83 is disengaged from the female coupling member 72. Next, the developer cartridge 28 is separated from the drum cartridge 27 by pulling the developer cartridge 28 out through the access opening 6. In this way, the developer cartridge 28 can be removed from the main casing 2 while the drum cartridge 27 remains mounted therein.

The male coupling member 83 is coupled with the female coupling member 72 when the developer cartridge 28 is being detached from the drum cartridge 27. Accordingly, the front end of the developer cartridge 28 rotates upward about the female coupling member 72. It is noted that if the roller shaft 46 of the developing roller 41 were fixed at the receiving portions 112, the circumferential movement of the roller shaft 46 about the female coupling member 72 will be restricted, and the front end of the developer cartridge 28 will be restricted from being rotated upward. However, according to the present embodiment, the movement allowing portions 109 are formed continuously from the bottom front edges of the receiving portions 112 in the drum cartridge 27. This configuration allows both ends of the roller shaft 46 to move from the receiving portions 112 to the movement allowing portions 109, thereby allowing the front end of the developer cartridge 28 to rotate around the female coupling member 72. Accordingly, the front end of the developer cartridge 28 can be raised without impediment, and the developer cartridge 28 can be smoothly detached from the drum cartridge 27.

As described above, according to the present embodiment, the laser printer 1 has the male coupling member 83, the urging spring 84, and the coupling mechanism 85 in the main casing 2. The developer cartridge 28 has the female coupling member 72 which can be engaged with the male coupling member 83. The urging spring 84 urges the male coupling member 83 in a direction toward the developer cartridge 28 when the developer cartridge 28 is mounted in the laser printer 1. The coupling mechanism 85 causes the male coupling member 83 to project to and retract from the developer cartridge 28 in association with the mounting and removing of the developer cartridge 28 to and from the laser printer 1. Accordingly, the male coupling member 83 is engaged with the female coupling member 72 when the developer cartridge 28 is mounted in the laser printer 1. The male coupling member 83 is disengaged from the female coupling member 72 when the developer cartridge 28 is removed from the laser printer 1.

With the above-described construction, the male coupling member 83 is moved between the engaged position and the disengaged position in association with mounting and removing of the developer cartridge 28 with respect to the main casing 2. Specifically, when mounting the developer cartridge 28, the operating pieces 108 provided on the developer cartridge 28 contact the locking pawls 93 and 105, and the projecting part 99 is engaged with the flange 90 of the male coupling member 83 and causes the male coupling member 83 to project to the engaged position. On the other hand, when removing the developer cartridge 28, the operating pieces 108 separate from the locking pawls 93 and 105, and the retracting part 100 becomes engaged with the flange 90 of the male coupling member 83, thereby moving the male coupling member 83 back to the disengaged position. Accordingly, by simply providing the projecting part 99 and retracting part 100 on the arm 94, which moves together with the rotation of the locking pawl 93, the male coupling member 83 can be reliably projected and retracted between the engaged position and the disengaged position in association with the mounting and detaching of the developer cartridge 28.

When the front cover 7 is opened, the CPU 114 forcibly halts the driving of the motor 113 in response. After the front cover 7 is opened, the developer cartridge 28 is removed from the main casing 2, as a result of which the male coupling member 83 is moved to the disengaged position, interrupting transfer of the driving force to the developer cartridge 28. Hence, it is ensured that the developer cartridge 28 is removed after the drive of the motor 113 has been halted. Since the operations of the developer cartridge 28 (process cartridge 20) are halted after the male coupling member 83 is shifted from the engaged position to the disengaged position, damage to and wear on the female coupling member 72 and male coupling member 83 can be prevented. As a result, it is unnecessary to form the female coupling member 72 and male coupling member 83 with a high-strength material, keeping the costs of the laser printer 1 low.

Further, by simply forming the projecting part 99 and retracting part 100 with a different thickness in the widthwise direction, the male coupling member 83 can be reliably projected and retracted between the engaged position and disengaged position. As a result, costs of the laser printer 1 can be further reduced.

Further, by urging the male coupling member 83 toward the developer cartridge 28 with the urging force of the urging spring 84, the male coupling member 83 can be reliably projected to the engaged position by placing the projecting part 99 in contact with the flange 90 of the male coupling member 83.

The male coupling member 83 is capable of projecting toward and retracting from the developer cartridge 28 to move between the engaged position and the disengaged position. Accordingly, the male coupling member 83 can be reliably engaged with and disengaged from the female coupling member 72. In this way, a driving force can be reliably transferred to the developer cartridge 28 and interrupted.

Further, the male coupling member 83 is projected and retracted in the widthwise direction, intersecting the mounting path for the developer cartridge 28 in association with the mounting and removal of the developer cartridge 28. Accordingly, the male coupling member 83 can be retracted from the mounting path before the developer cartridge 28 is mounted, preventing interference between the male coupling member 83 and developer cartridge 28 during the mounting process and allowing the developer cartridge 28 to be smoothly mounted in the main casing 2.

Moreover, a driving force inputted to the female coupling member 72 from the male coupling member 83 can be transferred to the supply roller 40 via the first idle gear 67 and supply roller gear 65 and can be transferred to the developing roller 41 via the first idle gear 67 and developer roller gear 66. The driving force inputted to the female coupling member 72 can also be transferred to the agitator 44 via the second idle gear 68, third idle gear 69, fourth idle gear 70, and agitator gear 71.

In another drive transfer path different from the drive transfer path using the male and female coupling members 83 and 72, the driving force of the motor 113 is transferred to the drum cartridge 27 via the drum drive gear 64 and drum gear 63. In other words, a driving force can be transferred to the photosensitive drum 30 along a separate path from the drive transferring paths for the supply roller 40, developing roller 41, and agitator 44, thereby achieving precise driving of the photosensitive drum 30 in order to form high-quality images.

When the developer cartridge 28 is mounted in the main casing 2, the locking spring 103 urges the locking pawl 93 toward the operating piece 108, thereby pressing the developer cartridge 28 toward the drum cartridge 27. As a result, the developer cartridge 28 cannot be detached from the drum cartridge 27. By configuring the locking pawl 93 with the additional function of preventing the developer cartridge 28 from being detached from the drum cartridge 27, the construction of the laser printer 1 can be simplified by reducing the number of components.

Further, the ends of the roller shaft 46 protruding from the developer cartridge 28 are received in the receiving portions 112 formed in the side plates 29 of the drum cartridge 27 to position the roller shaft 46 with respect to the drum cartridge 27. Then, the developer cartridge 28 can be mounted on the drum cartridge 27 by rotating the developer cartridge 28 downward about the roller shaft 46, enabling the developer cartridge 28 to be precisely mounted with respect to the drum cartridge 27.

According to the principles of a lever, only a small force is needed to rotate the developer cartridge 28 easily about the roller shaft 46 to mount the developer cartridge 28 on the drum cartridge 27. Further, by providing the locking pawl 105 on the opposite side of the developer cartridge 28 from the locking pawl 93, detachment of the developer cartridge 28 from the drum cartridge 27 can be restricted on both widthwise sides of the developer cartridge 28. In this way, it is possible to stably fix the developer cartridge 28 to the drum cartridge 27, while reliably restricting detachment of the developer cartridge 28 from the drum cartridge 27.

Ease of operations is improved by enabling the developer cartridge 28 to be mounted and removed via the access opening 6 after opening the front cover 7.

While the invention has been described in detail with reference to the specific embodiment thereof, it would be apparent to those skilled in the art that various changes and modifications may be made therein without departing from the spirit of the invention.

For example, in the above-described embodiment, an example is given for mounting the developer cartridge 28 onto and detaching the developer cartridge 28 from the drum cartridge 27 while the drum cartridge 27 is mounted in the main casing 2. However, the process cartridge 20 may be mounted in or removed from the main casing 2 while the developer cartridge 28 is attached to the drum cartridge 27. In this case, the same effects can be obtained when only the developer cartridge 28 is mounted in or removed from the main casing 2 by providing the operating pieces 108 on the developer cartridge 28 that rotate the locking pawls 93 and 105.

At least one end of the roller shaft 46 may protrude out from the at least one side plate 29 of the drum cartridge 27. In this case, at least one receiving portion 112 and at least one movement allowing portion 109 may be formed on the at least one side wall 29 to receive the at least one end of the roller shaft 46.

In the embodiment, the female coupling member 72 is provided on the cartridge side, while the male coupling member 83 is provided on the image-forming device side. However, a male-type coupling member may be provided on the cartridge side, while the female-type coupling member may be provided on the image-forming device side.

What is claimed is:

1. An image-forming device comprising:

a cartridge receiving portion that receives a cartridge detachably mounted therein;

a drive engaging unit that can move between an engaged position, in which the drive engaging unit transfers a driving force to the cartridge, and a disengaged position, in which the drive engaging unit fails to transfer a driving force to the cartridge; and a coupling member that moves the drive engaging unit between the engaged position and the disengaged position in association with mounting and detaching of the cartridge in the cartridge receiving portion, wherein the coupling member includes a first contact member that contacts the cartridge when the cartridge is mounted in the cartridge receiving portion, wherein when the cartridge is mounted in the cartridge receiving portion, the first contact member contacts the cartridge, thereby causing the drive engaging unit to move into the engaged position; and wherein when the cartridge is removed, the first contact member is disengaged from the cartridge, thereby causing the drive engaging unit to move into the disengaged position.

2. An image-forming device according to claim 1, wherein the cartridge includes a rotating member that can be driven by the driving force to rotate to form an image; and wherein the drive engaging unit transfers the driving force to the rotating member, thereby rotating the rotating member.

3. An image-forming device according to claim 1, wherein the drive engaging unit is capable of projecting and retracting with respect to the cartridge mounted in the cartridge receiving portion, the drive engaging unit being in the engaged position when the drive engaging unit is projecting to the cartridge and the drive engaging unit being in the disengaged position when the drive engaging unit is retracting away from the cartridge.

4. An image-forming device according to claim 3, wherein the drive engaging unit projects and retracts in a direction intersecting a path in which the cartridge is mounted to and detached from the cartridge receiving portion.

5. An image-forming device according to claim 3, wherein the coupling member further includes:

a projecting/retracting member that is engaged with the drive engaging unit and that causes the drive engaging unit to project and retract;

wherein the projecting/retracting member includes:

a projecting portion that causes the drive engaging unit to project; and a retracting portion that causes the drive engaging unit to retract, the drive engaging unit being selectively engaged with the projecting portion and the retracting portion;

wherein when the cartridge is mounted in the cartridge receiving portion, the first contact member contacts the cartridge, thereby causing the projecting portion to engage with the drive engaging unit; and wherein when the cartridge is removed, the first contact member is disengaged from the cartridge, thereby causing the retracting portion to engage with the drive engaging unit.

6. An image-forming device according to claim 5, wherein the projecting portion and the retracting portion are selectively interposed between the cartridge and the drive engaging unit;

wherein the projecting portion has a thickness in a direction that the cartridge opposes the drive engaging unit, the thickness of the projecting portion having a first value that allows the drive engaging unit to project toward the cartridge; and wherein the retracting portion has a thickness in the direction that the cartridge opposes the drive engaging unit, the thickness of the retracting portion having a second value that restricts the drive engaging unit from projecting toward the cartridge.

7. An image-forming device according to claim 6, further comprising a first urging member that urges the drive engaging unit toward the cartridge.

8. An image-forming device according to claim 5, further comprising a wall defining the cartridge receiving portion, wherein the coupling member includes a rotating member that is rotatably supported on the wall;

the projecting/retracting member and the first contact member are provided on the rotating member;

when the cartridge is mounted in the cartridge receiving portion, the first contact member contacts the cartridge, thereby causing the rotating member to rotate in a direction to engage the projecting portion with the drive engaging unit; and when the cartridge is removed from the cartridge receiving portion, the first contact member disengages from the cartridge, thereby rotating the rotating member to rotate in a direction to engage the retracting portion with the drive engaging unit.

9. An image-forming device according to claim 8, further comprising a second urging member that urges the first contact member to cause the rotating member to rotate in a direction to engage the retracting portion with the drive engaging unit.

10. An image-forming device according to claim 9, wherein the cartridge includes:

an image bearing member cartridge supporting an image bearing member that bears a developer image thereon; and a developer cartridge disposed upstream of the image bearing member cartridge, with respect to a cartridge mounting direction that the cartridge is mounted in the cartridge receiving portion, the developer cartridge being capable of being mounted on and detached from the image bearing member cartridge when the image bearing member cartridge is in a mounted state in the cartridge receiving portion, the developer cartridge supplying a developer to the image bearing member when the developer cartridge is mounted on the image bearing member cartridge; and the drive engaging unit projects toward and retracts from the developer cartridge.

11. An image-forming device according to claim 10, wherein the developer cartridge includes a first contact portion that is contacted by the first contact member.

12. An image-forming device according to claim 11, wherein when the developer cartridge is mounted on the image bearing member cartridge, the first contact member contacts the first contact portion, thereby restricting the developer cartridge from being removed from the image bearing member cartridge.

13. An image-forming device according to claim 12, wherein the second urging member urges the first contact member toward the first contact portion when the developer cartridge is mounted on the image bearing member cartridge.

14. An image-forming device according to claim 11, wherein the developer cartridge is mounted on the image bearing member cartridge by: first positioning, in the image bearing member cartridge, a downstream end of the developer cartridge with respect to the cartridge mounting direction; and then rotating an upstream end of the cartridge with respect to the cartridge mounting direction about the positioned downstream end until the first contact member contacts the first contact portion.

15. An image-forming device according to claim 14, wherein the developer cartridge includes a rotational shaft on the downstream end thereof with respect to the cartridge mounting direction, the rotational shaft projecting in a direction substantially orthogonal to the cartridge mounting direction, with at least one end of the rotational shaft protruding from the developer cartridge; and the image bearing member cartridge includes at least one receiving portion that receives the at least one end of the rotational shaft and that positions the rotational shaft with respect to the image bearing member cartridge.

16. An image-forming device according to claim 15, wherein the developer cartridge is separated from the image bearing member cartridge by rotating the upstream end of the developer cartridge about the drive engaging unit to disengage the first contact member from the first contact portion; and the image bearing member cartridge includes a movement allowing portion that allows the at least one end of the rotational shaft to move while the developer cartridge is being removed from the image bearing member cartridge.

17. An image-forming device according to claim 11, wherein the developer cartridge includes:

first and second side walls that oppose with each other in a direction substantially orthogonal to the cartridge moving direction, the first contact portion being provided on the first side wall; and a second contact portion provided on the second side wall; and further comprising:

a second contact member that contacts the second contact portion, when the developer cartridge is mounted on the image bearing member cartridge, to restrict the developer cartridge from being detached from the image bearing member cartridge; and a third urging member that urges the second contact member toward the second contact portion when the developer cartridge is being mounted on the image bearing member cartridge mounted in the cartridge receiving portion.

18. An image-forming device according to claim 1, further comprising a housing having an operation side, the cartridge being mounted in and removed from the cartridge receiving portion through the operation side.

19. A cartridge detachably mountable in an image-forming device, the image-forming device including a drive engaging unit and a coupling member, the drive engaging unit being capable of projecting and retracting between an engaged position, in which the drive engaging unit transfers a driving force to the cartridge, and a disengaged position, in which the drive engaging unit fails to transfer a driving force to the cartridge, the coupling member having a projecting portion that causes the drive engaging unit to project to the engaged position and a retracting portion that causes the drive engaging unit to retract to the disengaged position, the coupling member selectively engaging the projecting portion and the retracting portion with the drive engaging unit, the cartridge comprising:

a driving-force receiving unit that is capable of being engaged with the drive engaging unit in the engaged position to receive the driving force from the drive engaging unit; and a contact portion that contacts the coupling member, when the cartridge is mounted in the image-forming device, to cause the coupling member to engage the projecting portion with the drive engaging unit, and that separates from the coupling member, when the cartridge is removed from the image-forming device, to cause the coupling member to engage the retracting portion with the drive engaging unit.

20. A cartridge according to claim 19, wherein the driving-force receiving unit includes a rotating member that is driven to rotate by the driving force transferred from the drive engaging unit.

21. A cartridge according to claim 19, further comprising:

an image bearing member cartridge supporting an image bearing member that bears a developer image thereon; and a developer cartridge that is capable of being mounted on and removed from the image bearing member cartridge when the image bearing member cartridge is in a mounted state in the image-forming device, the developer cartridge supplying developer to the image bearing member, the developer cartridge being disposed on an upstream side of the image bearing member cartridge with respect to a cartridge mounting direction, in which the cartridge is mounted in the image-forming device, the driving-force receiving unit and the contact portion being provided on the developer cartridge.

22. A combination of an image-forming device and a cartridge detachably mountable in the image-forming device, the combination comprising:

an image-forming device; and a cartridge detachably mountable in the image-forming device, the image-forming device comprising:

a drive engaging unit, the drive engaging unit being capable of projecting and retracting between an engaged position, in which the drive engaging unit transfers a driving force to the cartridge, and a disengaged position, in which the drive engaging unit fails to transfer a driving force to the cartridge; and a coupling member, the coupling member having a projecting portion that causes the drive engaging unit to project to the engaged position and a retracting portion that causes the drive engaging unit to retract to the disengaged position, the coupling member selectively engaging the projecting portion and the retracting portion with the drive engaging unit, the cartridge comprising:

a driving-force receiving unit that is capable of being engaged with the drive engaging unit in the engaged position to receive the driving force from the drive engaging unit; and a contact portion that contacts the coupling member, when the cartridge is mounted in the image-forming device, to cause the coupling member to engage the projecting portion with the drive engaging unit, and that separates from the coupling member, when the cartridge is removed from the image-forming device, to cause the coupling member to engage the retracting portion with the drive engaging unit.

* * * * *